US009045885B2

(12) United States Patent
Thomas et al.

(10) Patent No.: US 9,045,885 B2
(45) **Date of Patent: *Jun. 2, 2015**

(54) INTEGRATED SWIVEL SPRAY AERATOR WITH DIVERTER

(75) Inventors: Kurt Judson Thomas, Indianapolis, IN (US); Josh Barber, New Castle, IN (US)

(73) Assignee: Delta Faucet Company, Indianapolis, IN (US)

( * ) Notice: Subject to any disclaimer, the term of this patent is extended or adjusted under 35 U.S.C. 154(b) by 474 days.

This patent is subject to a terminal disclaimer.

(21) Appl. No.: 12/348,758

(22) Filed: Jan. 5, 2009

(65) Prior Publication Data

US 2009/0114743 A1 May 7, 2009

Related U.S. Application Data

(63) Continuation of application No. 10/928,509, filed on Aug. 27, 2004, now Pat. No. 7,472,846.

(60) Provisional application No. 60/537,306, filed on Jan. 16, 2004.

(51) Int. Cl.
*B05B 3/02* (2006.01)
*A62C 31/02* (2006.01)
(Continued)

(52) U.S. Cl.
CPC ..... *E03C 1/084* (2013.01); *E03C 2001/082* (2013.01)

(58) Field of Classification Search
CPC .. B05B 3/1007; E03C 1/084; E03C 2001/082
USPC ..... 239/548, 562, 579, 537, 538, 540, 391, 239/392, 394, 549, 587.1, 587.3, 587.5, 239/581.1, 443, 444, 446, 447, 448, 449, 239/428.5, 587.4, 570, 571, 222.11, 393, 239/390; 601/169, 82; 285/265
See application file for complete search history.

(56) References Cited

U.S. PATENT DOCUMENTS 1,857,821 A * 5/1932 Richardson ..... 285/265
2,015,390 A * 9/1935 Williams ..... 464/123
(Continued)

FOREIGN PATENT DOCUMENTS

WO WO 8001309 A1 * 6/1980 ..... F16L 27/04

OTHER PUBLICATIONS

Design on Demand, Better Homes & Gardens, Feb. 2004, Cover & pp. 4-5 and 64.

(Continued)

*Primary Examiner* — Jason Boeckmann
*Assistant Examiner* — Steven M Cernoch
(74) *Attorney, Agent, or Firm* — Faegre Baker Daniels LLP

(57) ABSTRACT

A combination swivel spray aerator includes a stem that defines an inlet port for supplying water. The stem includes a neck and a swivel connector that is provided at one end of the stem. A spray head is coupled to the swivel connector in a swiveling manner. The spray head includes a housing and a swivel seal that seals between the housing and the swivel connector. A shroud is coupled to the stem for hiding at least the neck of the stem from view in order to provide a clean appearance. The swivel spray aerator further includes a diverter that switches between spray and aeration modes regardless which direction the spray head is rotated. A gimbal mechanism in the spray head allows the spray head to twist without requiring excessive swiveling friction.

24 Claims, 18 Drawing Sheets

(51) Int. Cl.

| | |
|---|---|
| ***B05B 1/14*** | (2006.01) |
| ***B05B 15/08*** | (2006.01) |
| ***E03C 1/084*** | (2006.01) |
| *E03C 1/08* | (2006.01) |

(56) References Cited

U.S. PATENT DOCUMENTS

| | | | | | |
|---|---|---|---|---|---|
| 2,415,285 | A | | 2/1947 | Hurst | |
| 2,529,223 | A | | 11/1950 | Moen | |
| 2,623,763 | A | * | 12/1952 | Fauser | 285/265 |
| 2,670,942 | A | | 3/1954 | Aghnides | |
| 2,904,356 | A | * | 9/1959 | Love | 285/226 |
| 2,935,265 | A | | 5/1960 | Richter | |
| 3,003,703 | A | * | 10/1961 | Lambton | 239/309 |
| 3,004,719 | A | * | 10/1961 | Pouppirt, Jr. | 239/381 |
| 3,198,558 | A | * | 8/1965 | Braden | 285/228 |
| 3,232,646 | A | * | 2/1966 | Stark | 285/226 |
| 3,334,818 | A | * | 8/1967 | Moen | 239/428.5 |
| 3,524,591 | A | | 8/1970 | Samuels et. al. | |
| 3,623,670 | A | * | 11/1971 | Wakeman et al. | 239/428.5 |
| 3,764,074 | A | | 10/1973 | James | |
| 3,786,995 | A | | 1/1974 | Manoogian et al. | |
| 3,902,671 | A | | 9/1975 | Symmons | |
| 3,998,390 | A | | 12/1976 | Peterson et al. | |
| 4,043,511 | A | | 8/1977 | Nakamura | |
| 4,089,471 | A | * | 5/1978 | Koenig | 239/381 |
| 4,134,548 | A | | 1/1979 | Harmony | |
| 4,221,338 | A | | 9/1980 | Shames et al. | |
| 4,226,260 | A | | 10/1980 | Schmitt | |
| 4,291,835 | A | | 9/1981 | Kaufman | |
| 4,480,857 | A | * | 11/1984 | Graves | 285/45 |
| 4,493,343 | A | | 1/1985 | Arnold et al. | |
| 4,561,593 | A | | 12/1985 | Cammack et al. | |
| 4,582,253 | A | | 4/1986 | Gerdes | |
| 4,598,866 | A | | 7/1986 | Cammack et al. | |
| 4,645,244 | A | * | 2/1987 | Curtis | 285/114 |
| 4,671,539 | A | * | 6/1987 | Reneau | 285/18 |
| D293,708 | S | | 1/1988 | Shames et al. | |
| 4,957,135 | A | * | 9/1990 | Knapp | 137/454.6 |
| 5,111,994 | A | | 5/1992 | Gonzalez | |
| 5,127,681 | A | * | 7/1992 | Thelen et al. | 285/121.7 |
| 5,154,355 | A | | 10/1992 | Gonzalez | |
| 5,201,468 | A | * | 4/1993 | Freier et al. | 239/383 |
| 5,205,490 | A | | 4/1993 | Steinhardt et al. | |
| 5,215,258 | A | | 6/1993 | Jursich | |
| 5,246,169 | A | | 9/1993 | Heimann et al. | |
| 5,361,804 | A | | 11/1994 | Keller et al. | |
| 5,862,985 | A | | 1/1999 | Neibrook et al. | |
| 6,360,965 | B1 | | 3/2002 | Clearman et al. | |
| 6,381,774 | B1 | | 5/2002 | Wales | |
| 6,394,133 | B1 | * | 5/2002 | Knapp | 137/615 |
| 6,547,966 | B2 | | 4/2003 | Allmendinger et al. | |
| 6,631,859 | B2 | | 10/2003 | Schmidt | |
| 6,659,372 | B2 | * | 12/2003 | Marsh et al. | 239/560 |
| D486,557 | S | | 2/2004 | Graves et al. | |
| D486,890 | S | | 2/2004 | Graves et al. | |
| D488,538 | S | | 4/2004 | Graves et al. | |
| 6,786,429 | B2 | | 9/2004 | Ouyoung | |
| 7,032,272 | B2 | | 4/2006 | Haenlein | |
| 7,243,863 | B2 | | 7/2007 | Glunk | |
| 7,472,846 | B2 | * | 1/2009 | Thomas et al. | 239/587.4 |
| 8,056,836 | B2 | * | 11/2011 | Chen et al. | 239/587.5 |
| 2001/0008255 | A1 | * | 7/2001 | Marsh et al. | 239/380 |

OTHER PUBLICATIONS

Delta, Michael Graves Collection™, Single Lever Widespread Kitchen Faucets, Models 186 & 187, Maintenance and Installation Sheets, Dec. 23, 2003, © 2003, Division of Masco Indiana.

Delta, Kitchen Faucets, Single Handle, The Michael Graves Collection™, Widespread, 3 and 4 Hole Sink Applications, Quick Snap® Hose Installation, Standard Specifications, © 2003 Masco Corporation of Indiana.

* cited by examiner

INTEGRATED SWIVEL SPRAY AERATOR WITH DIVERTER

REFERENCE TO RELATED APPLICATIONS

The present application is a continuation of U.S. patent application Ser. No. 10/928,509, filed Aug. 27, 2004, now U.S. Pat. No. 7,472,846 which claims the benefit of U.S. Provisional Patent Application No. 60/537,306, filed Jan. 16, 2004, the disclosures of which are hereby incorporated by reference.

BACKGROUND

The present invention generally relates to spray aerators and more specifically, but not exclusively, concerns a swivel type spray aerator that provides a clean appearance while allowing water to be diverted when the spray head is rotated in either direction.

Swivel spray aerators provide additional functionality to kitchen faucets as well as other types of faucets. The swivel spray aerators allow the user to swivel a stream of water over a greater area of a sink, which allows the sink and dishes as well as other objects, to be cleaned more thoroughly. Often times, swivel aerators have a spray function that provides additional cleaning power over the standard aerated stream. Typically, a diverter in the aerator is used to switch between the spray and aerated modes. Traditionally, swivel aerators have been designed as add-ons to an existing faucet, providing a functional but not aesthetically pleasing addition to the end of the faucet spout. This aesthetically displeasing design is in part due to the construction of the swivel sprays. An example of the construction of a typical swivel aerator 50 is depicted in FIG. 1. The swivel aerator 50 includes a ball stem 52 that is attached to the faucet spout and a swivel head 54 that swivels about the ball stem 52. As shown, the ball stem 52 has a neck 55 that is attached to a swivel ball 57, around which the head 54 swivels. An o-ring seal 59 is disposed between the swivel ball 57 and the head 54 so as to prevent water leakage. In order to provide the maximum coverage in a sink, the angle that the swivel head 54 is able to travel needs to be maximized. Generally, the size of the neck 55 of the ball stem 52 determines the limit of the angular travel of the head 54. The smaller the neck 55, the larger the angular travel. However, as apparent in FIG. 1, the smaller stem sizes cause the aerator 50 to look gangly and do not provide a smooth extension of the spout. In addition, to prevent the pinching of fingers, the neck 55 of the stem 52 is tapered, which increases its length and accentuates the small diameter of the neck 55 of the stem 52.

It is desirable to have some sort of shroud that would hide the small stem 52 so as to provide a smooth transition between the faucet spout and the swivel head 54. However, the introduction of the shroud can create a whole host of issues that can make its use practically infeasible. As an example, installing a shroud over the stem 52 would cause tolerance issues between the components in the swivel aerator 50 that would make mass production impractical. Either the clearance between the shroud and the swivel head 54 would be too small and the shroud would bind due to concentricity issues with the swivel ball 57, or the clearance would be so large to create a pinching hazard, in which the skin of the user's finger could be pinched between the shroud and the head 54. Another issue created by the use of the shroud concerns sealing the of the swivel aerator 50. Generally, most spherical ball seals, such as the seal 59 in FIG. 1, need to be pre-loaded in order to operate correctly. This pre-loading is accomplished by the swivel head 54 pushing on the swivel ball 57 from inside the wetted area, at location 60 in FIG. 1, so that the ball 57 is seated against the seal 59. However, the downfall with this type of seal configuration occurs when an attempt is made to shroud the exposed stem 52. If the shroud comes in contact with the swivel head 54, this contact unloads the seal 59, thereby causing a leak, and/or binds the assembly. To alleviate the leakage and binding problems, a larger gap between the swivel head 54 and the shroud would be required. As mentioned before, this large gap between the shroud and the swivel head 54 is unsightly and is a potential pinching hazard. Grime can also collect in the large gap, which in turn can create health and safety concerns.

Another issue with swivel spray aerators concerns the diverter that is used to switch between spray and aerated modes. Diverters generally fall into two categories, pull-down and twist type diverters. The pull-down diverter requires a protrusion or ring around the swivel head 54 of the aerator 50 to activate the diverter and requires a design that allows for linear travel of the protrusion. It should be appreciated that the protrusion or ring used to actuate the pull-down diverter can make the aerator 50 aesthetically less appealing. The twist type diverter does not have the above-mentioned aesthetic limitations, since its motion is in a rotational axis. However, twist type diverters can be difficult to operate since there is often no rotational limit on the swivel seal between the stem 52 and the head 54. This requires that a relatively large frictional force exist between the stem 52 and the swivel head 54 so that the diverter can be twisted without twisting the entire assembly. The swivel resistance or friction at the swivel has to be unusually high to compensate for the torque exerted on the diverter, and this higher resistance at the swivel makes swiveling of the head 54 more difficult. As should be appreciated, it would be desirable if the diverter motion was separated from the swivel motion so as to allow the two to operate independently. Moreover, in typical twist type diverters, the twisting motion is made at a location that is offset from the swivel motion such that the swivel head 54 can swivel out of position during twisting, thereby misdirecting the flow of water from the head 54. It would be advantageous for the swivel and diverter motions to operate about the generally same center of rotation, in so doing provide a better feel for the user. The range of motion of the twist diverter is also an area with room for improvement. The diverter often cycles one direction to switch for aerated and another direction for spray. There are often limits to the travel at each extreme. It would be advantageous if the twist diverter could be turned in either direction to change alternately between spray and aerator modes and have a full 360 degrees of rotation.

Thus, there is a need for improvement in this field.

SUMMARY

One aspect of the present invention concerns an apparatus that includes a stem that defines an inlet passage for supplying fluid. The stem includes a neck and a swivel connector provided at one end of the stem. A swivel head is coupled to the swivel connector in a swiveling manner for dispensing the fluid. The swivel head includes a housing and a swivel seal that seals between the housing and the swivel connector. A shroud is coupled to the stem for hiding at least the neck of the stem from view. The stem draws the housing against the shroud to pull swivel connector against the seal.

Another aspect concerns an apparatus that includes a stem which defines an inlet port for supplying fluid. A swivel head includes a twist type diverter that switches between a first flow mode and a second flow mode of the fluid upon twisting the swivel head relative to the stem. A gimbal mechanism couples the stem to the swivel head to allow swiveling of the swivel head and twisting of the diverter to occur independently of one another.

A further aspect concerns an apparatus that includes a fluid dispenser housing and a valve retainer disposed within the housing. The retainer has at least two valve members oriented at a first angle relative to one another that divides a circle into generally even sectors. A valve member is disposed within the housing, and the valve member defines at least two openings for supplying fluid for different fluid stream patterns. The two openings are oriented relative to one another at a second angle that is about half the first angle. The two valve members seal and unseal the two openings in an alternating manner as the valve member and valve retainer rotate relative to one another.

Still yet another aspect concerns a spray aerator that includes a spray head constructed and arranged to switch when twisted between a spray mode in which a spray of water is supplied and an aeration mode in which an aerated stream of the water is supplied. The spray head includes means for switching between the aeration mode and the spray mode regardless of which direction the spray head is twisted.

Further forms, objects, features, aspects, benefits, advantages, and embodiments of the present invention will become apparent from a detailed description and drawings provided herewith.

BRIEF DESCRIPTION OF DRAWINGS

The detailed description of the drawings particularly refers to the accompanying figures in which.

DESCRIPTION OF SELECTED EMBODIMENTS

Figure 1:
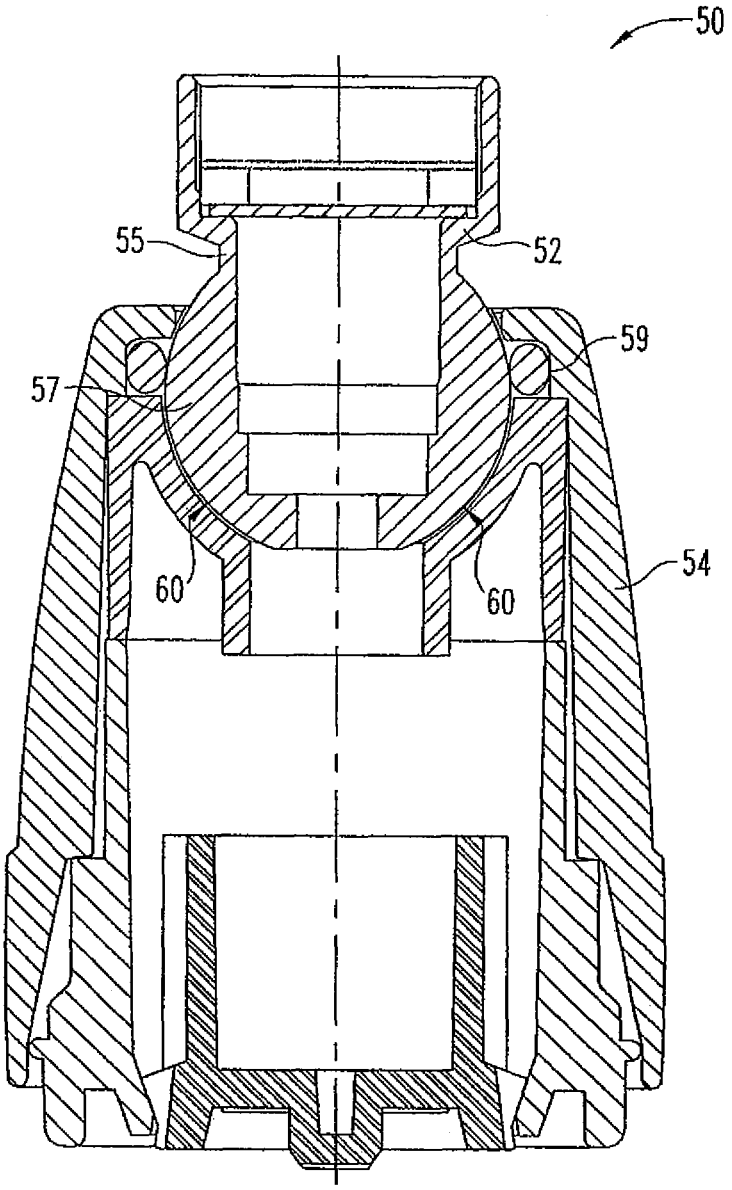
Fig. 1 (PRIOR ART)
FIG. 1 is cross-sectional view of a typical swivel type aerator.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
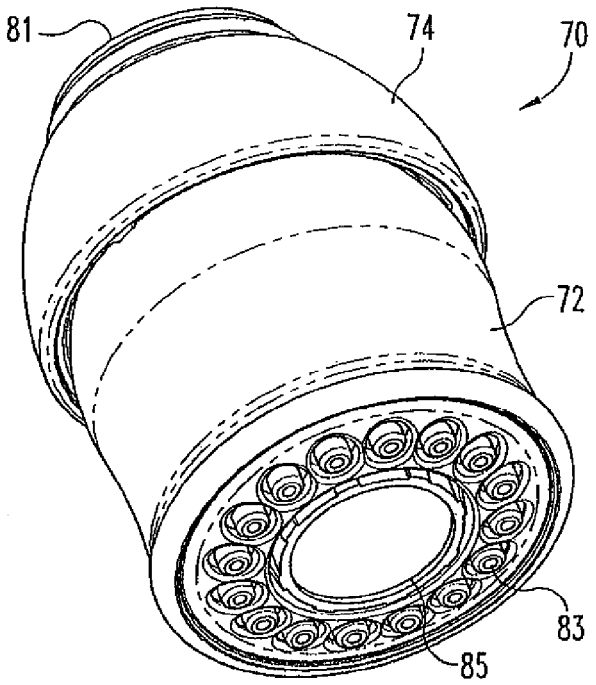
FIG. 2 is a bottom perspective view of a swivel type combination spray and aerator according to one embodiment of the present invention.
Figure 3:
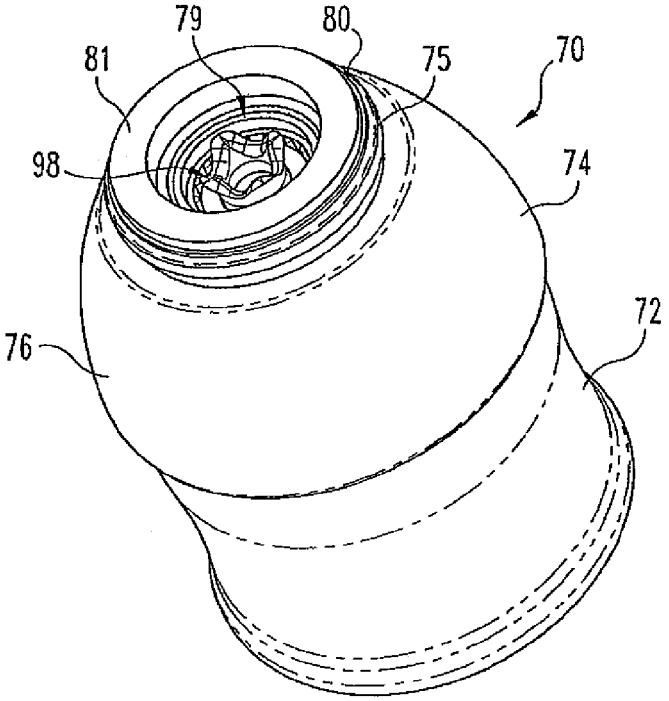
FIG. 3 is a top perspective view of the FIG. 2 swivel spray aerator.

A swivel spray aerator 70 according to one embodiment, among others, of the present invention will now be described with reference to FIGS. 2, 3, 4 and 5. As shown in FIGS. 2 and 3, the swivel spray aerator 70 includes a spray or swivel head 72 that is able to swivel in order to direct the flow of water. Although the spray aerator 70 will be described with reference to water faucets, it is envisioned that the spray aerator 70 can be used to direct other types of fluids and can modified for use in other types of operational environments. The spray aerator 70 incorporates a shroud 74 that provides a smooth transition between the faucet spout and the spray head 72. As depicted, the shroud 74 includes a connector portion 75 that is configured to connect to the faucet spout 75 and a cover portion 76. In the illustrated embodiment, the connector 75 is externally threaded for threading onto the faucet, but it is contemplated that the swivel spray aerator 70 can be coupled to the faucet in other manners, such as through a snap fit. Inside the connector 75, the shroud 74 has an inlet port 79 that is configured to receive the water from the faucet. In a gasket groove 80 that surrounds the inlet port 79 (FIG. 4), the swivel spray aerator 70 has a gasket 81 that minimizes leakage at the interface between the faucet and the swivel spray aerator 70. The outside of the shroud 74 in the illustrated embodiment has a generally semispherical or round shape. However, it should be recognized that the shroud 74 can be shaped differently in other embodiments. For instance, the shroud 74 can be shaped to coincide with a peculiar spout shape so as to provide a smooth transition between the spout and the swivel spray aerator 70. Opposite the shroud 74, the spray head 72 has a sprayer 83 and an aerator 85 that supply a spray of water and an aerated stream of water, respectively.

Figure 4:
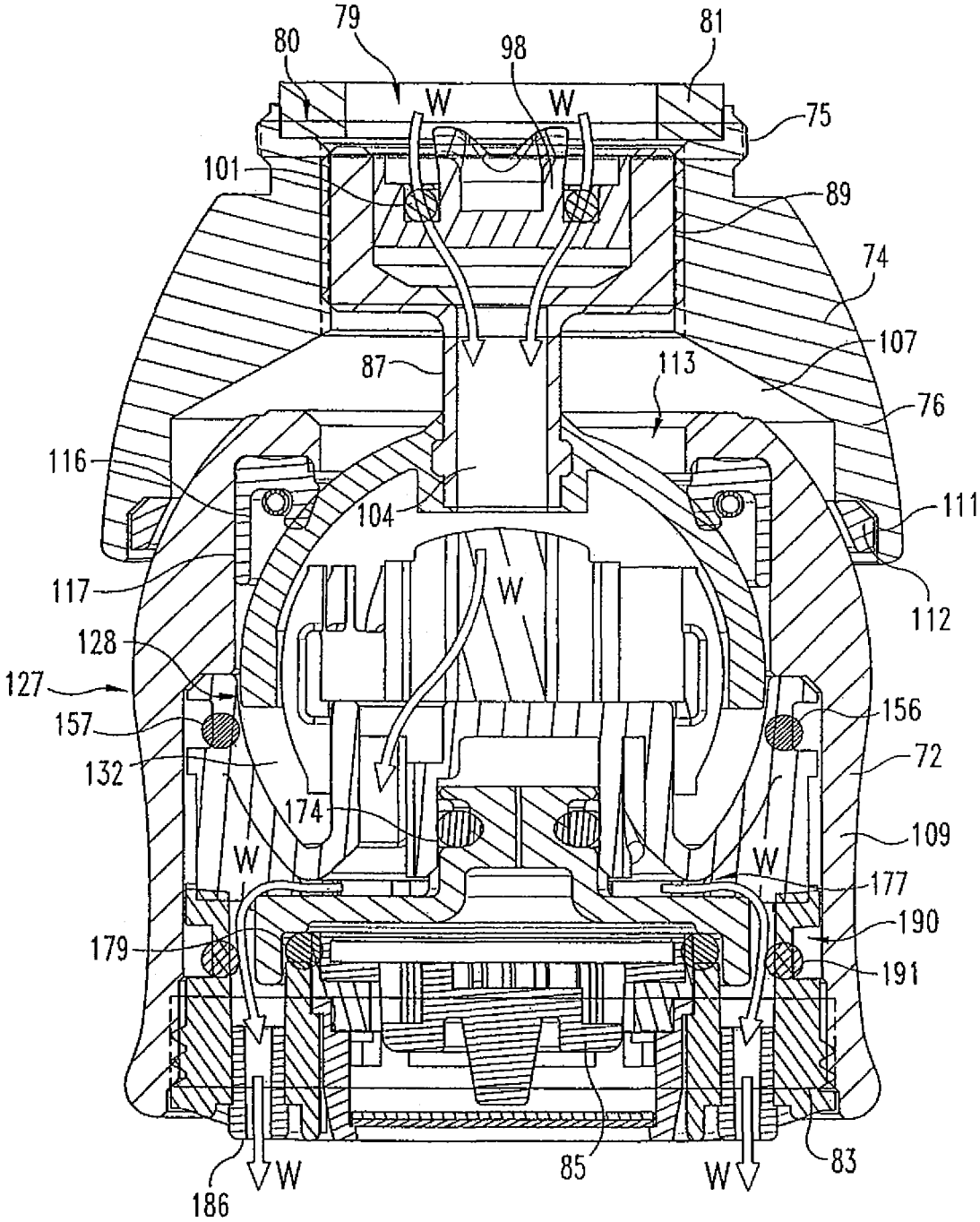
FIG. 4 is a first, side cross-sectional view of the FIG. 2 swivel spray aerator in a spray operational mode.
Figure 5:
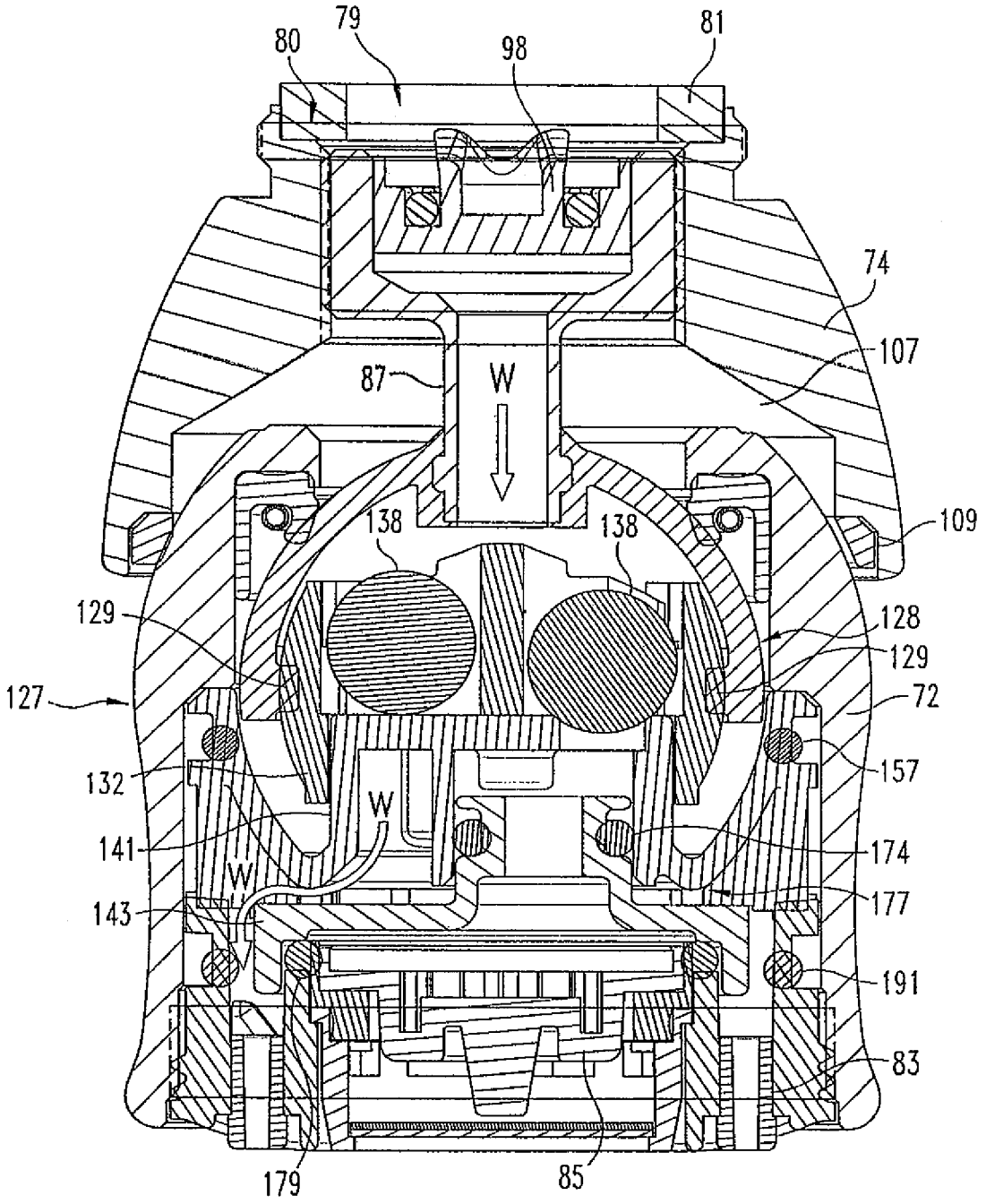
FIG. 5 is a second, side cross-sectional view of the FIG. 2 swivel spray aerator in the spray mode.
Figure 6:
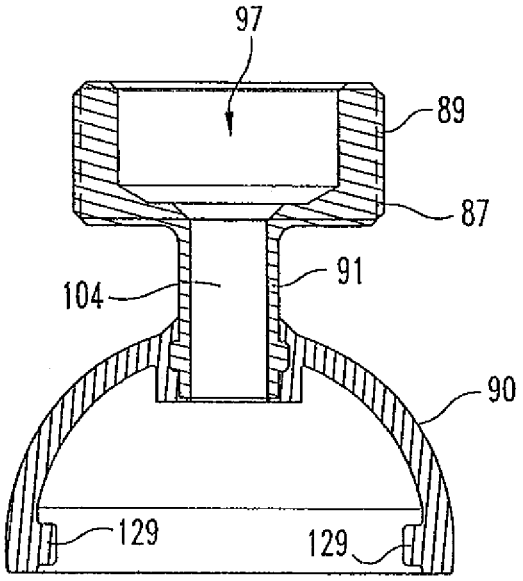
FIG. 6 is a cross-sectional view of a stem used in the FIG. 2 swivel spray aerator.
Figure 7:
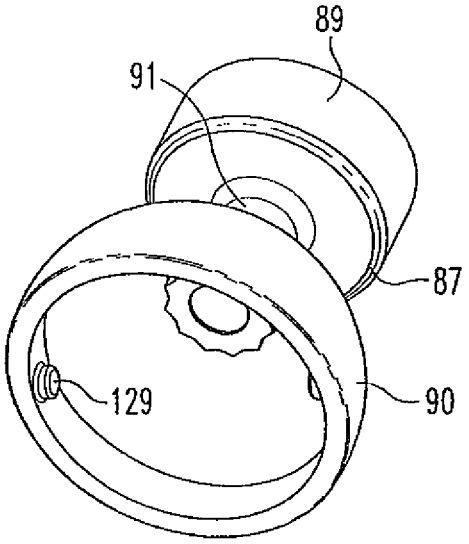
FIG. 7 is a bottom perspective view of the FIG. 6 stem.
Figure 9:
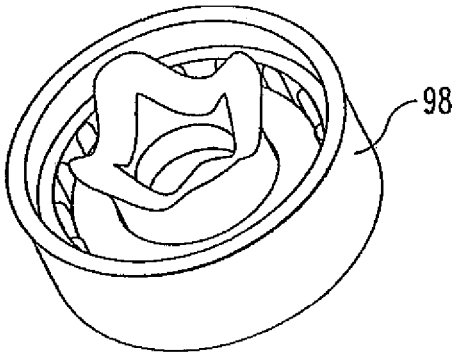
FIG. 9 is a perspective view of a flow restrictor used in the FIG. 2 swivel spray aerator.
Figure 10:
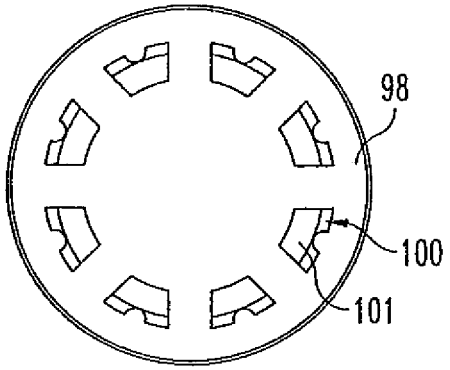
FIG. 10 is a bottom plan view of the FIG. 9 flow restrictor.

Referring to FIGS. 4 and 5, among its many other functions, the shroud 74 is designed to cover or hide, at least in part, a stem assembly 87 upon which the spray head 72 swivels. As can be seen in FIGS. 6 and 7, the stem assembly 87 includes a shroud connector 89 that connects the stem assembly 87 to the shroud 74, a swivel connector 90 around which the head 72 swivels and a neck 91 that connects the shroud connector 89 to the swivel connector 90. The shroud 74 in FIG. 8 defines a stem connector cavity 95 in which the shroud connector 89 of the stem assembly 87 is secured. In the embodiment shown, the shroud connector 89 is externally threaded and the stem connector cavity 95 is internally threaded such that the stem assembly 87 can be threaded into the shroud 74. Nevertheless, it should be recognized that the shroud 74 and the stem assembly 87 can be connected together in other manners. Inside, the shroud connector 89 defines a flow restrictor cavity 97 in which a flow restrictor 98 of the type illustrated in FIGS. 9 and 10 can be placed in order to restrict water flow, if so desired. As can be seen, the flow restrictor 98 has one or more flow openings 100 through which water flows and a restrictor gasket 101 that partially covers the flow openings 100. With reference again to FIG. 6, a flow passage 104 is defined in the neck 91 of the stem assembly 87 so as to allow the water from the restrictor 98 to flow into the spray head 72.

Figure 8:
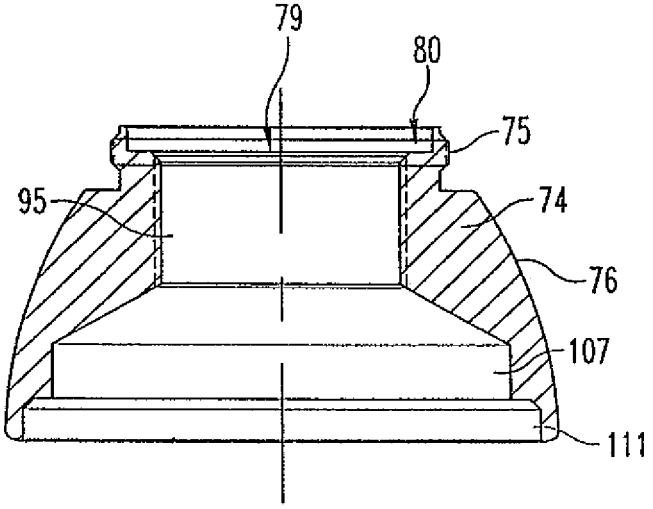
FIG. 8 is a side cross-sectional view of a shroud for the FIG. 2 swivel spray aerator.
Figure 11:
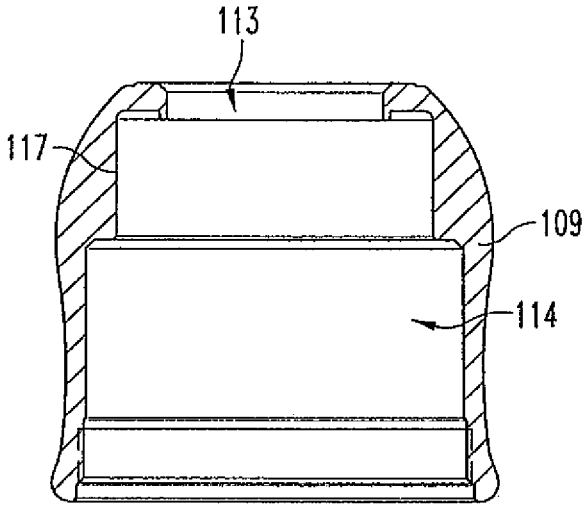
FIG. 11 is a cross-sectional view of a housing for the FIG. 2 swivel spray aerator.

In order to achieve the shrouded smooth swivel seal, the illustrated shroud design was developed. As mentioned before, the shroud 74 is designed to cover the neck 91 so as to provide a clean appearance. The shroud 74 defines a head cavity 107 in which at least a portion of the head 72 is covered, as is depicted in FIGS. 4, 5 and 8. The head 72 has a housing 109 (FIG. 11) in which the components of the spray head 72 are housed. Around the opening of the head cavity 107, the shroud 74 has a skid ring groove 111 in which a skid ring or member 112 is secured. As can be seen in FIG. 11, the housing 109 defines a stem opening 113 through which the stem 87 extends, and the housing 109 has an internal cavity 114 in which the components of the head 72 are disposed. Between the housing 109 and the swivel connector 90, as is depicted in FIG. 4, the swivel head 72 has a swivel seal 116 that prevents or minimizes water leakage between the swivel head 72 and the stem assembly 87. In the illustrated embodiment, the swivel seal 116 is retained in a swivel seal groove 117 in the housing 109. To the achieve the smooth swivel appearance, the shroud 74 is to used to pre-load the swivel seal 116, as shown in FIGS. 4 and 5. Instead of the pushing up from below in the wetted area like the previous swivel aerator design 50 of FIG. 1, the shroud 74 in the illustrated embodiment pulls up on the stem 74 from above (relative to the drawing) to preload the swivel seal 116 against the swivel connector 90. Please note that the directional terms, such as "up", "down", "above" and "below", are being used merely for the convenience of the reader so as to aid in understanding of the present invention, and these directional terms are not in any way meant to limit the present invention to a specific orientation.

Figure 12:
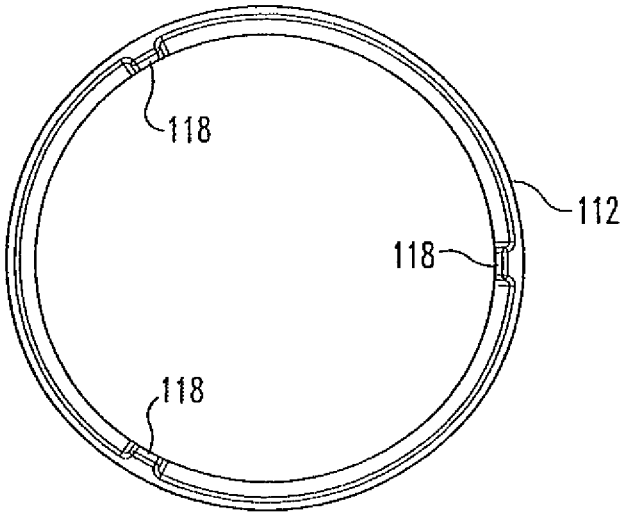
FIG. 12 is a bottom plan view of a skid ring used in the FIG. 2 swivel spray aerator.
Figure 13:
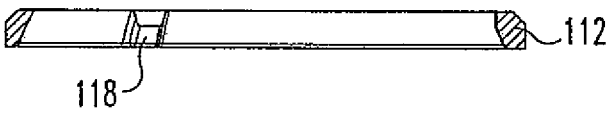
FIG. 13 is a side, cross-sectional view of the FIG. 12 skid ring.

To preload the swivel seal 116 by pulling on the stem 74, the shroud 74 contacts the housing 109 either directly or indirectly. In the illustrated embodiment, the shroud 74 indirectly contacts the housing 109 through the skid ring 112. The skid ring 112 in one form is made of plastic, but it should be recognized that the skid ring 112 can be made of other materials. The contact between the shroud 74 and housing 109 occurs at three distinct points through the skid ring 112, thereby minimizing the need for concentricity between the swivel connector 90 and the housing 109. Any variation that does occur is absorbed by the flexibility of the skid ring 112, since there are no other hard contacts between mating parts. As a result of this construction, the swivel spray aerator 70 provides a completely clean, integrated look between the faucet spout and the swivel aerator 70. Gapping between the shroud 74 and the housing 109 is reduced so as to minimize any chance of pinching a finger. As shown in FIGS. 12 and 13, the skid ring 112 has three contact protrusions 118 that extend radially inwards and are spaced apart about 120° from one another. In other embodiments, it is envisioned that more or less contact protrusions 118 than illustrated can be used, and the contract protrusions 118 can be located at other positions or shaped differently. For example, although possibly less desirable, it is contemplated that the inside of skid ring 112 in other embodiments is smooth such that the skid ring 112 contacts the housing 109 in a continuous fashion. In other embodiments, the skid ring 112 is not ring-shaped, but can have other shapes. For instance, instead of using a ring, the contact protrusions 118 can be glued directly to the shroud 74 or secured in some other manner.

Figure 14:
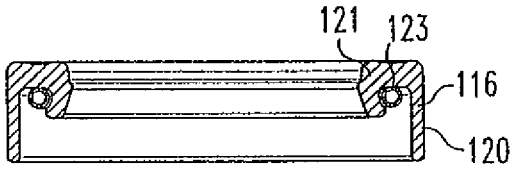
FIG. 14 is a side, cross sectional view of a seal used in the FIG. 2 swivel spray aerator.

As mentioned before, the direct or indirect contact between the shroud 74 and the housing 109 allows the shroud 74 to pull the stem 87 against the swivel seal 116 so as to preload the seal 116. The swivel seal 116 in the FIG. 14 illustrated embodiment has a cross-sectional profile that has a shape similar to a lower case "r", but as should be recognized, the swivel seal 116 can be shaped differently in other embodiments. As shown, the swivel seal 116 has a body 120 with a stem contacting flange 121 that is configured to seal against the swivel connector 90 of the stem 87. Between the body 120 and the stem contacting flange 121, the swivel seal 116 has a flange support 123 that assists in supporting the stem contacting flange 121. The flange support 123 in the illustrated embodiment is in the form of a garter spring made of stainless steal, but it should be appreciated that the flange support 123 can have a different construction in other embodiments. With the above-discussed construction, the swivel head 72 is able to maintain a seal during swiveling when the shroud 72 is installed. Moreover, this design eliminates the need for placing a seal at the interface between the shroud 74 and the housing 109, although one could be used if so wished. Nevertheless, if a seal were provided, the black rubber or other debris from the seal would discolored the visible finished parts, and the seal performance would vary depending the different surface finishes on the housing 109 (i.e., textured versus smooth finishes).

As mentioned before, the diverters in typical spray aerators must cycle in one direction to alternate between aeration and spray modes. Further, the swivel and twist motions for operating typical spray aerators are dependent on one another, and the swivel motion is normally offset from the twist motion, whereby the operator experiences an awkward or difficult feel when using the aerator. The swivel spray aerator 70 in the embodiment illustrated in FIG. 4 incorporates a diverter 127 that includes a restraining or gimbal type mechanism 128 that reduces or eliminates these problems as well as other problems. With the diverter 127, the swivel and twisting motions occur around the same general rotational center, and the gimbal mechanism 128 separates the swivel motion of the spray head 72 from the twisting motions that are used to cycle between the spray and aeration modes. Nonetheless, it is envisioned that the rotational centers for the twisting and swivel motions can be offset from one another in other embodiments, if so desired.

Figure 15:
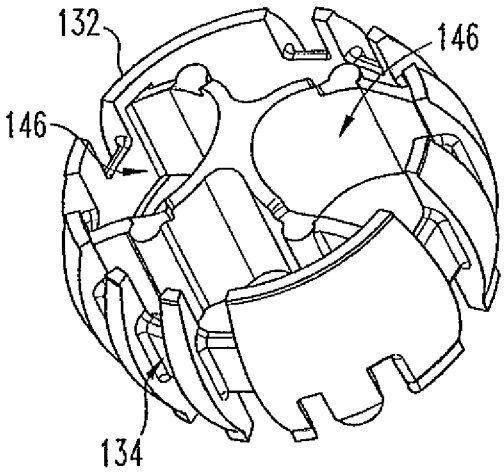
FIG. 15 is a perspective view of a retainer used in the FIG. 2 swivel spray aerator.
Figure 16:
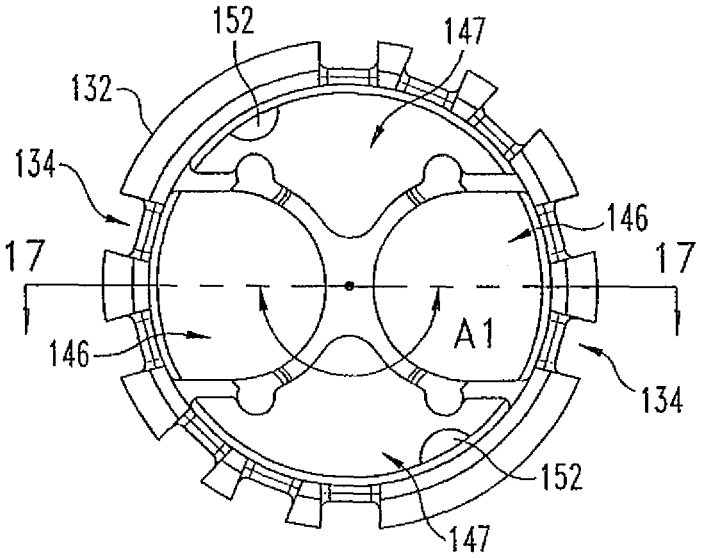
FIG. 16 is a top plan view of the FIG. 15 retainer.
Figure 17:
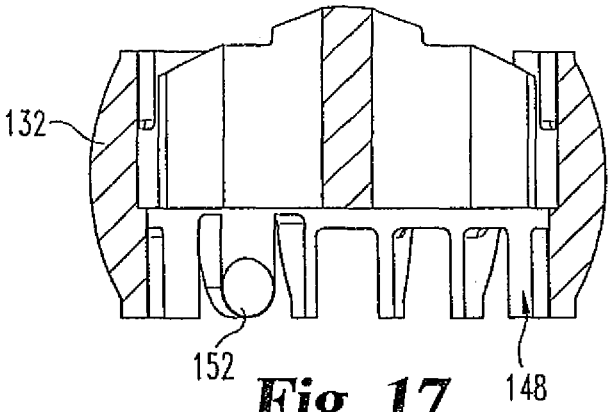
FIG. 17 is a cross-sectional view of the FIG. 15 retainer as taken along line 17-17 in FIG. 16.

Referring to FIGS. 5, 6 and 7, the restraining or gimbal mechanism 128 includes a pair of opposing gimbal pins or members 129 that extend inside the swivel connector 90 so as to engage a valve retainer 132. The retainer 132, as shown in FIGS. 15, 16 and 17, has gimbal slots 134 that receive the gimbal pins 129. In the illustrated embodiment, the retainer 132 has a rounded shape so as to partially fit inside the connector 90 while allowing the swiveling motion, but it should be appreciated that the retainer 132 can have a different overall shape in other embodiments. Likewise, the rounded shape of the connector 90 also aids in the swiveling motion. During swiveling, the retainer 132 is able to pivot about the axis defined between the gimbal pins 129, and the gimbal pins 129 are also able to slide within the slots 134 in the retainer 132 such that the spray head 72 can swivel in multiple directions. However, when the head 72 is twisted, the gimbal pins 129 engage the retainer 132 so that the retainer 132 remains rotationally fixed as the rest of the head 72 rotates or twists about the stem 87, which in turn changes the operational mode of the diverter 127. Thus, the diverter 127 is able to operate in any swivel orientation and is able to operate independent from the friction on the seal 116. That is, the friction between the seal 116 and the stem 87 is not needed in order to actuate the diverter 127. As a result, friction can be minimized so that the spray head 72 can be swiveled rather easily, if so wished.

Figure 18:
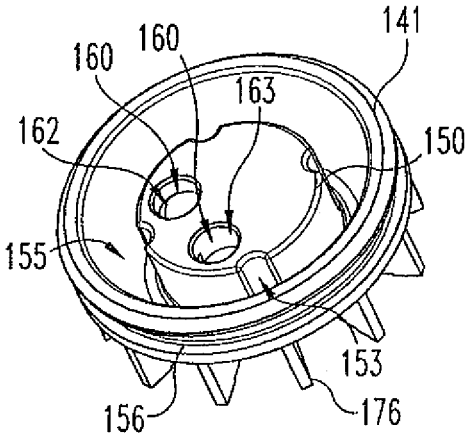
FIG. 18 is a perspective view of a valve plate used in the FIG. 2 swivel spray aerator.

As mentioned previously, the diverter 127 is able to switch between the aeration and spray modes regardless of which direction the spray head 72 is twisted. As illustrated in FIG. 5, the diverter 127 further includes at least two diverter balls or seal members 138, a valve plate or member 141, and a diverter plate or member 143. Although the seal members 138 in the illustrated embodiment will be described as having a rounded or spherical shape, it should be recognized that the seal members 138 in other embodiments can be shaped differently and/or take on a different form. For example, the seal members 138 in further embodiments can include umbrella type valves and/or flaps, to name a few examples. With reference to FIG. 16, the diverter balls 138 are received in opposing retainer cavities 146 in the retainer 132 such that the balls 138 are oriented apart from one another at a first angle A1 that is about one-hundred and eighty degrees (180°), and the diverter balls 138 act as check valves so as to divert the water flow. Between the retainer cavities 146, the retainer 132 has opposing flow openings 147 through which water flows. The retainer 132 in FIG. 17 further has a valve plate cavity 148 in which a retainer engagement portion 150 of the valve plate 141 (FIG. 18) is received so that both the retainer 132 and the valve plate 141 share a common rotational axis. Around the valve plate cavity 148, the retainer 132 has one or more detent tabs 152 that are configured to engage a series of one or more detent notches 153 formed around the retainer engagement portion 150, as is depicted in FIGS. 17 and 18. The detent tabs 152 engage the detent notches 153 so as to temporarily lock the relative positions of the retainer 132 and the valve plate 141, thereby keeping the diverter 127 in the desired spray or aeration mode. When the user rotates the spray head 72, the users sense a popping feeling as the diverter 127 switches between the spray and aeration modes. In the FIG. 19 embodiment, the four detent notches 153 are oriented approximately ninety degrees (90°) apart. Although the diverter 127 in the illustrated embodiment has two detent tabs 152 and four detent notches 153, it should be recognized that the diverter 127 can have more or less of these detent components and the detent components can be oriented at other angles. For example, it is envisioned that in other embodiments the detent tabs 152 and notches 153 can be omitted so as to allow a combination of operational modes, without the popping sensation. Surrounding the retainer engagement portion 150, the valve plate 141 has a swivel cavity 155 that is configured to receive and allow movement of the swivel connector 90 of the stem 87 within the cavity 155. The valve plate 141 has a seal retainer 156 for retaining a seal 157 that seals between the valve plate 141 and the housing 109 to prevent water bypassing the diverter 127, as is depicted in FIGS. 4 and 5.

Figure 19:
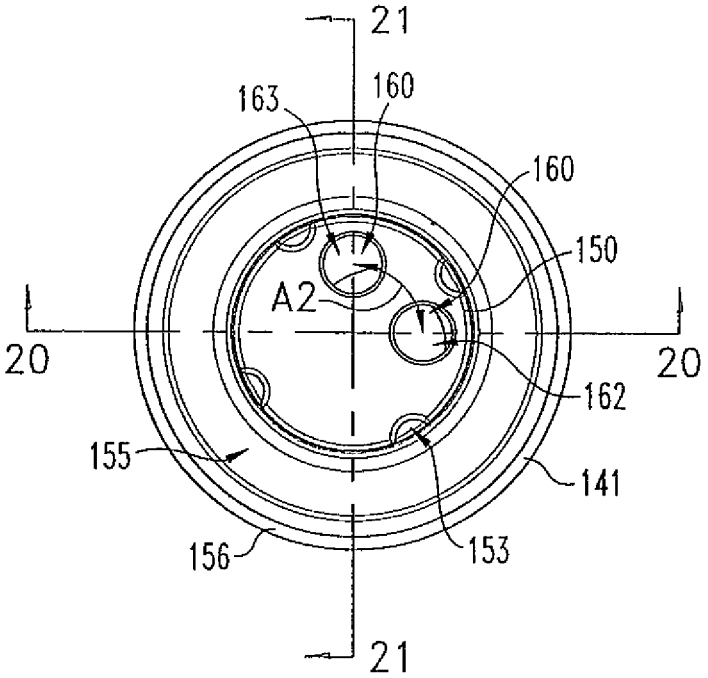
FIG. 19 is a top plan view of the FIG. 18 valve plate.
Figure 20:
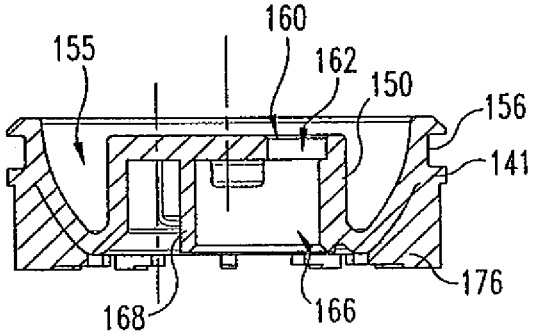
FIG. 20 is a first, cross-sectional view of the FIG. 18 valve plate as taken along line 20-20 in FIG. 19.
Figure 21:
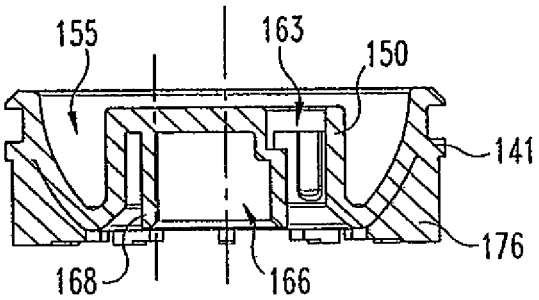
FIG. 21 is a second, cross-sectional view of the FIG. 18 valve plate as taken along line 21-21 in FIG. 19.
Figure 22:
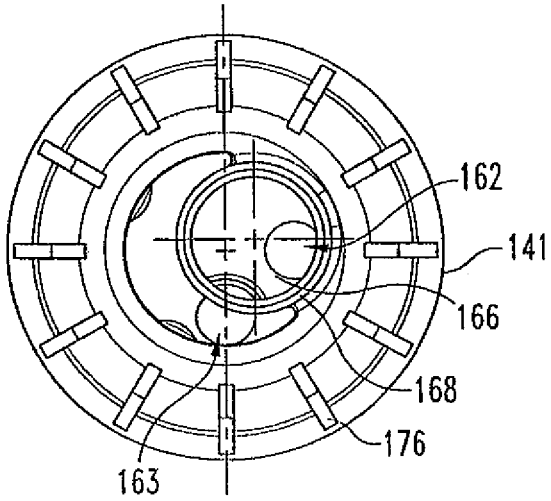
FIG. 22 is a bottom plan view of the FIG. 18 valve plate.
Figure 23:
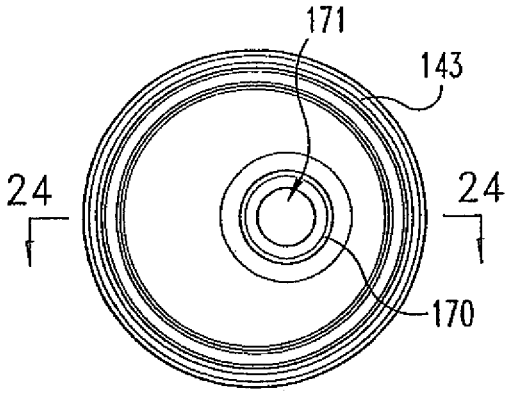
FIG. 23 is a top plan view a diverter plate used in the FIG. 2 swivel spray aerator.

As can be seen in FIGS. 18 and 19, the valve plate 141 on the retainer engagement portion 150 has two flow openings or ports 160 that are oriented apart at a second angle A2 that is about ninety degrees (90°). In the illustrated embodiment, the flow openings 160 are circular in shape, but in other embodiments, the flow openings 160 can be shaped differently. One of the openings 160 is an aeration opening or port 162 through which water flows during the aeration mode, and the other opening 160 is a spray opening or port 163 through which water flows during the spray mode of the diverter 127. With reference to FIGS. 20 and 22, the aeration opening 162 opens into an aeration cavity 166 that is defined in a connection member 168 of the valve plate 141. The aeration cavity 166 in the connection member 168 is sized to receive a connector tube 170 that extends from the diverter plate 143. The connector tube 170 defines a tube passage through which water from the aeration opening 162 flows. The connector tube 170 has a seal retention groove 173 in which a seal 174 is received. Referring again to FIGS. 4 and 5, the seal 174 in the retention groove 173 forms a seal between the connector tube 170 and the connection member 168 so as to minimize leakage of the water to be aerated. As shown in FIGS. 21 and 22, the spray opening 163 in the valve plate 141 opens outside the connection member 168 so that the water for spraying flows outside and around the diverter plate 143. The valve plate 141 further has one or more spacer ribs 176 that space apart the valve plate 141 and the diverter plate 143 to form a flow gap 177, which permits the flow of water W to the sprayer 83, as is depicted in FIGS. 4 and 5. It should be appreciated that the flow paths for the spray and aeration modes in other embodiments can be swapped such that the aeration flow path can flow outside the connection member 168 and the spray water flow path can flow inside the connection member 168.

Figure 24:
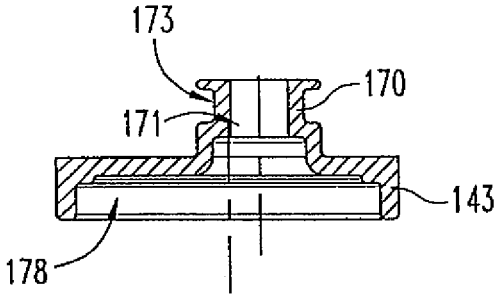
FIG. 24 is a cross-sectional view of the FIG. 23 diverter plate as taken along line 24-24 in FIG. 23.
Figure 25:
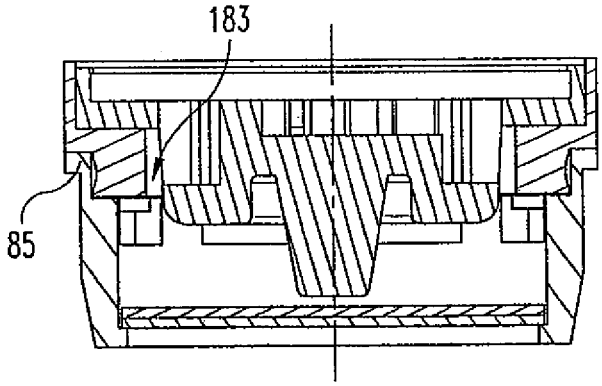
FIG. 25 is a cross-sectional view of an aerator for the FIG. 2 swivel spray aerator.
Figure 26:
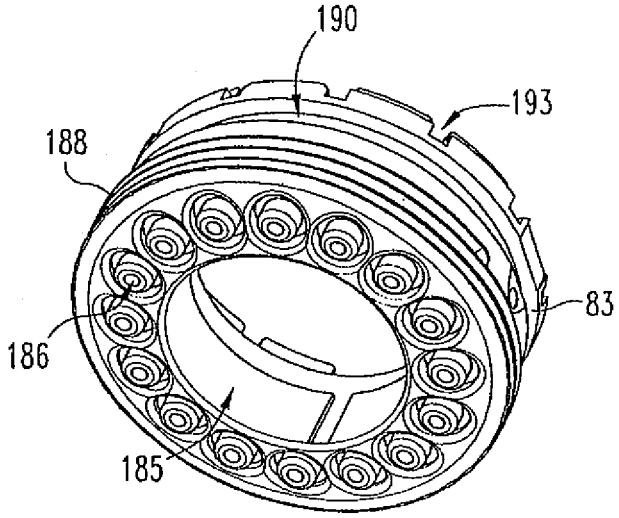
FIG. 26 is a bottom perspective view of a sprayer for the FIG. 2 swivel spray aerator.
Figure 27:
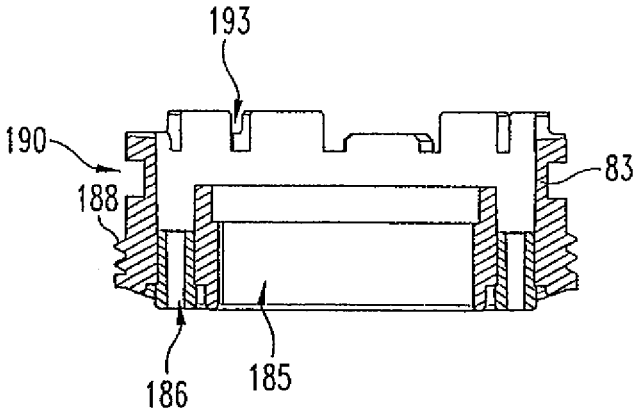
FIG. 27 is a side cross-sectional view of the FIG. 26 sprayer.
Figure 28:
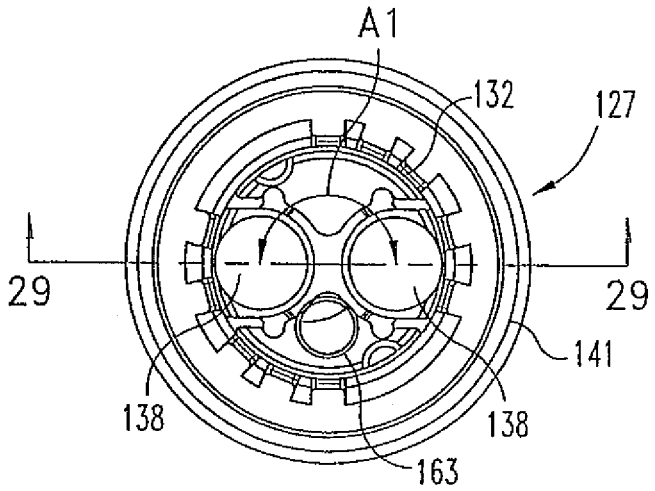
FIG. 28 is a top plan view of a portion of a diverter assembly for the FIG. 2 swivel spray aerator.

In FIG. 24, the diverter plate 143 defines an aerator cavity 178 in which the aerator 85 is received. An aerator seal 179 seals between the aerator 85 and the diverter plate 143 so as to minimize leakage from the aerator 85. The aerator 85, as is shown in FIG. 25, has one or more aerator openings 183 from which aerated water is dispensed. In the illustrated embodiment, the aerator 85 is received inside an aerator cavity 185 in the sprayer 83, which is shown in FIGS. 27 and 28. Around the aerator cavity 185, the sprayer 83 has a series of spray nozzles 186 that create a spray pattern of water. The sprayer 83 further has several housing engagement flanges 188 that engage and frictionally secure the sprayer 83 inside the housing 109. It should be appreciated that the sprayer 83 as well as other components can be secured to the housing 109 in other manners, such as with adhesive. A seal retention groove 190 in the sprayer 83 is configured to retain a sprayer seal 191 that seals between the sprayer 83 and the housing 109 so as to minimize water leakage. Near the valve plate 141, the sprayer 83 has a series of spacer notches 193 that engage the spacer ribs 176 on the valve plate 141 (FIG. 20). The notches 193 are configured to transfer the twisting motion of the spray head 72 to the valve plate 141. As the housing 109 is twisted, the sprayer 83 in turn rotates the valve plate 141 through the notches 193.

Figure 29:
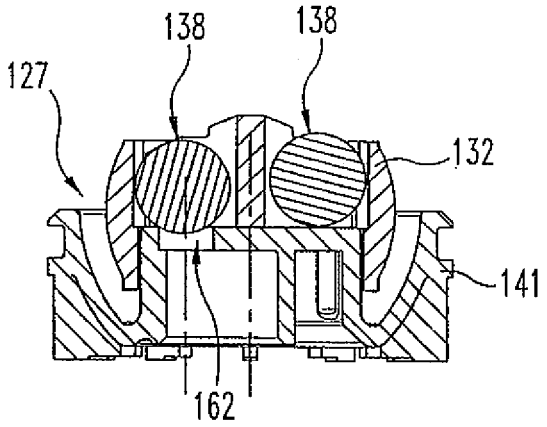
FIG. 29 is a cross-sectional view of the FIG. 28 diverter assembly as taken along line 29-29 in FIG. 28.

As previously noted, the seal retainer balls 138 in the illustrated embodiment are oriented approximately one-hundred and eighty degrees (180°) from one another, and the flow openings 160 are oriented approximately ninety degrees (90°) apart. With this orientation, the diverter 127 can alternate between spray and aeration modes regardless of which direction the spray head 72 is twisted. As mentioned before, the gimbal pins 129 cause the retainer 132 to remain stationary as the housing 109 of the spray head 72 is twisted in either direction (i.e., clockwise or counterclockwise). When the spray head 72 is twisted, the valve plate 141 rotates relative to the retainer 132 such that the aeration 162 and spray 163 openings are alternately opened and closed. The detent tabs 152 retain the spray head 72 in the desired orientation. FIGS. 28 and 29 illustrate the relative orientations of the balls 138 and the flow ports 160 when the diverter 127 is in the spray mode. As shown, the spray opening 163 is opened, and the aerator opening 162 is closed. With each ninety-degree (90°) change in position, the port 160 that was opened is closed and the port 160 that was closed is opened. This allows the diverter 127 to change from an aerated stream to a spray or from a spray to an aerated stream with each twist to the spray head 72. This works in both the clockwise and counterclockwise directions, and does not require a rotational limit stop, thereby providing a more intuitive diverter function for the user.

It should be recognized that the above-mentioned angles do not have to be exact, due to many factors including manufacturing tolerances, and can vary so long as the diverter 127 is generally able to operate in the manner as described herein. It was discovered that having the balls 138 angled evenly around a circle from one another and having the flow openings 160 oriented at approximately half the angle between the balls 138 allows that diverter 127 to alternate between the spray and aeration modes. Consequently, it is envisioned that other orientations or angles of the balls 138 and flow openings 160 can be used in other embodiments. For example, the diverter 127 in other embodiments can include three balls 138 that oriented about one-hundred and twenty degrees (120°) from one another, and the valve plate 141 includes two flow openings 160 that are oriented about sixty degrees (60°) from one another. Each sixty degree (60°) turn of the spray head 72, in either direction, causes the spray head 72 to switch between the spray and aeration modes. As should be appreciated, the above-mentioned angles can be reversed in other embodiments, depending on the desired results. That is, for example, the balls 138 can be oriented about ninety degrees (90°) relative to one another in other embodiments, and the flow openings 160 can be oriented about one-hundred and eighty degrees (180°) from one another. For instance, in one embodiment, the valve plate 141 has four flow openings 160 that are evenly spaced (i.e., 90°), with the pairs of opposing aeration 162 and spray 163 openings oriented apart at about one-hundred and eighty degrees (180°). In this embodiment, the balls 138 are oriented about ninety degrees (90°) relative to one another such that as the spray head 72 is twisted in either direction the diverter 127 cycles between three modes, a spray mode, a combination spray-aeration mode and an aeration mode.

A swivel spray aerator 194 according to another embodiment will now be described with reference to FIGS. 30 and 31. As should be recognized, the swivel spray aerator 194 in FIGS. 30 and 31 shares a number of components in common with the swivel spray aerator 70 described above, and for the sake of brevity as well as clarity these common components will not be again discussed in great detail. Like the previous embodiment, the swivel spray aerator 194 includes the spray head 72 mounted in a swiveling manner on the stem 87, and the spray head 72 includes the diverter 127 with the gimbal type mechanism 128 of the type described above. As noted above, the diverter 127 includes the retainer 132, the retainer balls 138, the valve plate 141 and the diverter plate 143. The flow openings 160 in the valve plate 141 and the balls 138 are oriented in the same relative positions as described above so that the diverter 127 switches between spray and aeration modes every ninety-degree (90°) turn of the spray head 72, regardless of direction. The aerated water from the diverter 127 is delivered via the aerator 85, and a water spray is supplied through the spray 83.

Figure 30:
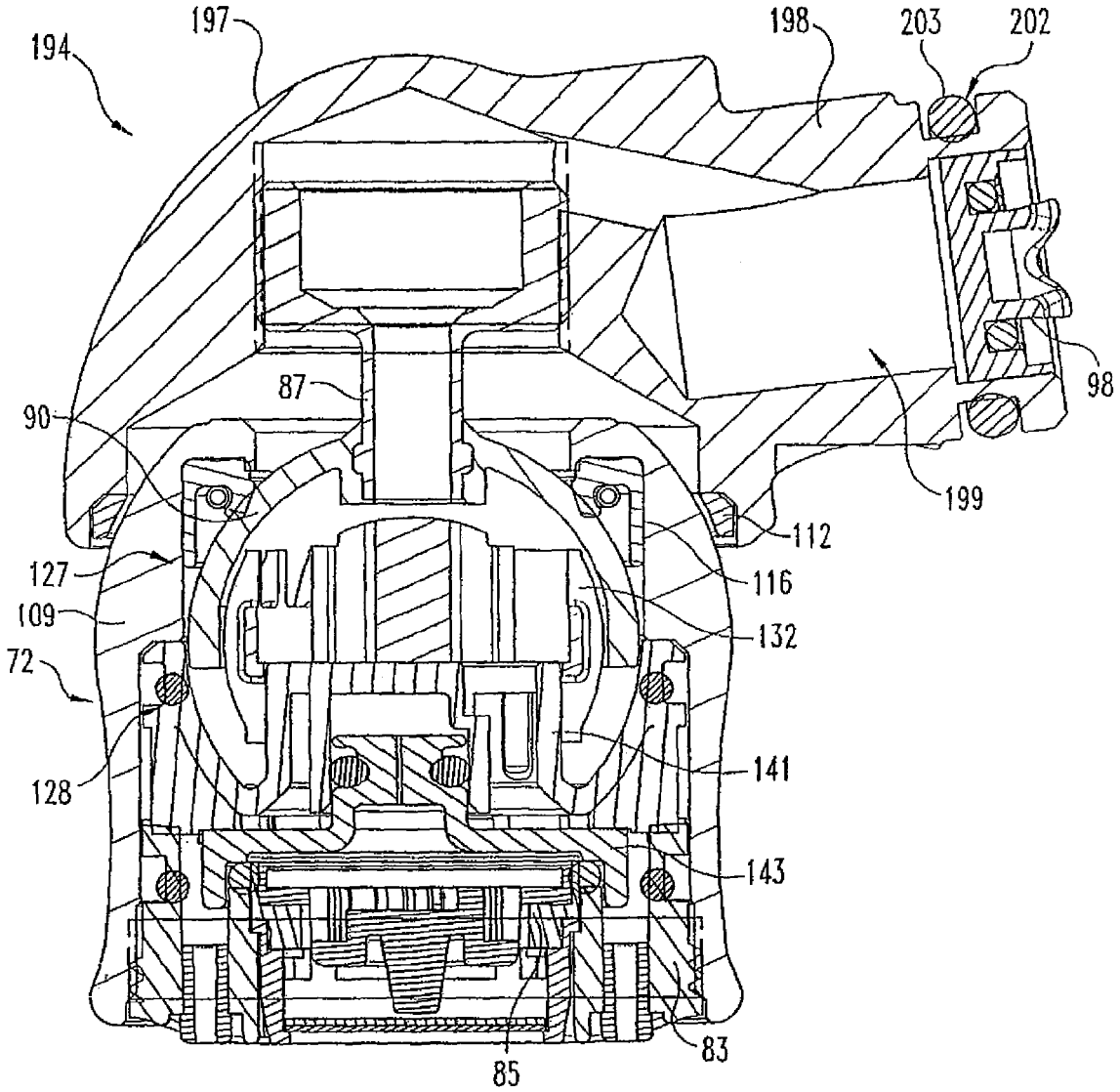
FIG. 30 is a first, cross-sectional view a swivel spray aerator according to another embodiment.
Figure 31:
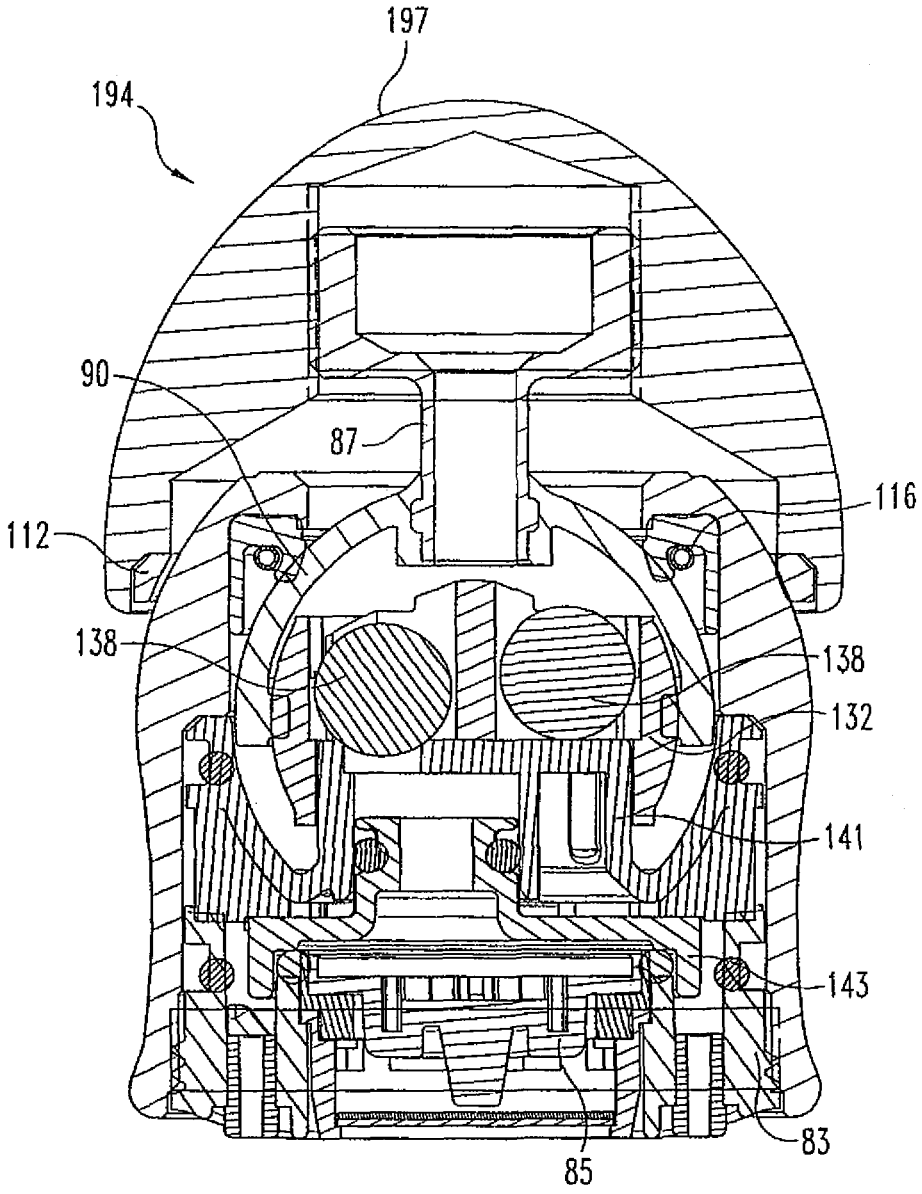
FIG. 31 is a second, cross-sectional view the FIG. 30 swivel spray aerator.

Although the spray heads operate in the same fashion, one notable distinction between the swivel spray aerator of FIG. 2 and the swivel spray aerator 194 in FIGS. 30 and 31 is that the swivel spray aerator 194 of FIGS. 30 and 31 includes a shroud 197 with an inlet port member 198 that extends generally perpendicular the rest of the swivel spray aerator 194. As shown, the inlet port member 198 defines an inlet port 199 with the flow restrictor 98 that supplies water to the spray head 72. The inlet port member 198 is sized to be received in a faucet and has a gasket groove 202 with a gasket 203 that seals against the spout. The shroud 197 engages the housing 109 of the spray head 72 in a fashion similar to that described above so as to provide a smooth, virtually gap-free transitional appearance between the shroud 197 and the spray head 72. Like the previous embodiment, the shroud 197 has the skid ring 112 that rests against the housing 109. During assembly, the stem 87 is threaded into the shroud 197, whereby the swivel connector 90 of the stem 87 is pulled up against the swivel seal 116 in the housing 109 and the housing 109 rests against the skid ring 112. As should be appreciated, the construction of the swivel spray aerator 194 in FIGS. 30 and 31 provides aesthetically pleasing appearance as well as a better feel for the user when swiveling the spray head 72 and twisting the spray head 72 between operational modes.

It is should be realized that one or more of the components from the embodiments discussed above can be integrated together to form a single unit. For example, it is envisioned that the features of the valve plate 141 and the diverter plate 143 can be incorporated into a single component in other embodiments. Also, it is contemplated that selected individual components can be manufactured as separate parts that can be assembled together. Although not likely gaining the complete benefits created by the above-discussed combination of features, selected features of the above-described embodiments can be incorporated into other types of devices. As an example, while the swivel spray aerators in the illustrated embodiments utilized twist type diverter mechanisms, it should be recognized that the shroud structure and/or the gimbal type mechanism 128 used to swivel the head 72 can be integrated with pull down or other types of diverter mechanisms. Likewise, the above-discussed diverter mechanisms can be utilized with spray heads that do not swivel or do not utilize a shroud, if so desired.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. An apparatus comprising: a stem defining an inlet port for supplying fluid; a swivel head operably coupled to the stem and including a twist type diverter; the diverter including at least one seal member to switch between a first flow mode and a second flow mode of the fluid upon twisting the swivel head relative to the stem, wherein the at least one seal member comprises a plurality of diverter balls, and the valve retainer includes a plurality of retainer cavities receiving the plurality of diverter balls; a gimbal mechanism coupling the stem to the swivel head to allow swiveling of the swivel head relative to the stem, while preventing the twisting of the at least one seal member relative to the stem in response to twisting of the swivel head relative to the stem; and a swivel connector supported by the stem and including gimbal pins; wherein the gimbal mechanism includes a valve retainer operably coupled to the swivel connector and receiving the at least one seal member, the swivel connector, the valve retainer and the at least one seal member positioned in a nested arrangement, the valve retainer being restrained by the gimbal pins from rotating about a longitudinal axis upon twisting of the swivel head relative to the stem, while being configured to swivel about a transverse axis perpendicular to the longitudinal axis when the swivel head is swiveled relative to the stem, the gimbal pins of the swivel connector defining the transverse axis, the transverse axis extending through the at least one seal member.

2. The apparatus of claim 1, wherein the gimbal mechanism allows swiveling of the swivel head and twisting of the diverter to occur independently of one another.

3. The apparatus of claim 1, wherein:

the valve retainer defines a pair of opposing grooves;

the gimbal members are slidably received in the grooves of the retainer;

the diverter includes a valve plate with at least one flow port; and the at least one seal member selectively seals the flow port upon twisting of the swivel head.

4. The apparatus of claim 1, wherein the gimbal mechanism is configured to have the swiveling of the swivel head and the twisting of the diverter operate about a same general center of rotation.

5. The apparatus of claim 1, further comprising:

a shroud covering at least a portion of the stem; and a skid member disposed between the shroud and the swivel head.

6. The apparatus of claim 1, wherein the diverter is configured to switch between the first flow mode and the second flow mode regardless of which direction the swivel head is twisted.

7. The apparatus of claim 1, wherein the valve retainer and the swivel head are configured to swivel relative to the stem about the same transverse axis.

8. A spray head comprising: a swivel connector; a swivel head operably coupled to the swivel connector and including a twist type diverter, the diverter including a valve plate with at least one flow port; a valve retainer cooperating with the diverter, wherein at least one seal member is supported by the valve retainer for selectively sealing at least one flow port of the valve plate to switch between a first flow mode and a second flow mode upon twisting the swivel head about a longitudinal axis, wherein the at least one seal member comprises at least one diverter ball, and the valve retainer includes at least one retainer cavity receiving the at least one diverter ball; and a restraining mechanism operably coupling the valve retainer and the swivel connector, the restraining mechanism including a pair of opposing grooves defined by one of the valve retainer and the swivel connector, and a pair of opposing members slidably received in the grooves of the one of the valve retainer and swivel connector, the opposing members within the grooves of the restraining mechanism configured to restrain the valve retainer from rotating relative to the swivel connector about the longitudinal axis upon twisting of the swivel head while permitting the valve retainer to swivel relative to the swivel connector about a transverse axis perpendicular to the longitudinal axis, the opposing members of the restraining mechanism defining the transverse axis, the transverse axis extending through the at least one seal member.

9. The spray head of claim 8, wherein the swivel connector is defined by a stem defining an inlet port for supplying fluid.

10. The spray head of claim 8, wherein swiveling of the swivel head and twisting of the diverter operate about a same general center of rotation.

11. The spray head of claim 8, further comprising:

a shroud covering at least a portion of the swivel connector; and a skid member disposed between the shroud and the swivel head.

12. The spray head of claim 8, wherein the diverter is configured to switch between the first flow mode and the second flow mode regardless of which direction the swivel head is twisted.

13. The spray head of claim 8, wherein the valve retainer and the swivel head are configured to swivel relative to the swivel connector about the same transverse axis.

14. A spray head comprising: a swivel connector defining a cavity; a swivel head including a twist type diverter that switches between a first flow mode and a second flow mode upon twisting the swivel head about a longitudinal axis; and a valve retainer operably coupled to the swivel head and configured to swivel relative to the swivel connector about a transverse axis perpendicular to the longitudinal axis, the valve retainer including at least one cavity, at least one seal member received within the at least one cavity of the valve retainer, wherein the at least one seal member comprises at least one diverter ball; a plurality of gimbal pins operably coupled to the valve retainer for restricting rotation of the valve retainer about the longitudinal axis upon twisting of the swivel head relative to the swivel connector, while allowing the valve retainer to swivel relative to the swivel connector about a transverse axis perpendicular to the longitudinal axis, the gimbal pins defining the transverse axis; wherein at least a portion of the valve retainer is received within the cavity of the swivel connector, at least a portion of the at least one seal member is received within the valve retainer, and the transverse axis extends through the swivel connector, the valve retainer, and the at least one seal member.

15. The spray head of claim 14, wherein the valve retainer and the swivel head are configured to swivel about a common axis relative to the swivel connector.

16. The spray head of claim 14, wherein the swivel connector is defined by a stem defining an inlet port for supplying fluid.

17. The spray head of claim 14, wherein:

the valve retainer defines a pair of opposing grooves;

the swivel connector includes a pair of the gimbal pins slidably received in the grooves of the retainer;

the diverter includes a valve plate with at least one flow port; and the at least one seal member selectively seals the flow port upon twisting of the swivel head.

18. The spray head of claim 14, wherein swiveling of the swivel head and twisting of the diverter operate about a same general center of rotation.

19. The spray head of claim 14, further comprising:

a shroud covering at least a portion of the swivel connector; and a skid member disposed between the shroud and the swivel head.

20. The spray head of claim 14, wherein the diverter includes means for switching between the first flow mode and the second flow mode regardless of which direction the swivel head is twisted.

21. The spray head of claim 14, wherein the valve retainer is restrained from rotating about a longitudinal axis upon twisting of the swivel head relative to the swivel connector, while being configured to swivel about a transverse axis perpendicular to the longitudinal axis when the swivel head is swiveled relative to the swivel connector.

22. A spray head comprising: a stem defining an inlet port for supplying fluid; a swivel connector supported by the stem; a swivel head operably coupled to the swivel connector and including a twist type diverter configured to switch between a first flow mode and a second flow mode of the fluid; a valve retainer operably coupled to the swivel connector in a nested arrangement to switch between the first flow mode and the second flow mode upon twisting the swivel head about a longitudinal axis; at least one seal member received in a nested arrangement within the valve retainer, wherein the at least one seal member comprises at least one diverter ball, and the valve retainer includes at least one retainer cavity receiving the at least one diverter ball; and a gimbal mechanism coupling the swivel connector to the valve retainer to allow swiveling of the valve retainer relative to the swivel connector about a first transverse axis perpendicular to the longitudinal axis, and a second transverse axis perpendicular to the first transverse axis and the longitudinal axis; the gimbal mechanism including a pair of gimbal pins supported by one of the swivel connector and the valve retainer, the gimbal pins defining the first transverse axis, the first transverse axis extending through the at least one seal member, and grooves defined in the other of the valve retainer and the swivel connector to slidably receive the gimbal pins and define the second transverse axis; wherein the gimbal pins within the grooves allow the valve retainer to pivot about the first transverse axis, and the gimbal pins are configured to slide within the grooves such that the valve retainer pivots about the second transverse axis.

23. The spray head of claim 22, wherein the first and second transverse axes intersect the longitudinal axis within the swivel connector and the valve retainer.

24. The spray head of claim 22, wherein the gimbal pins restrict rotation of the valve retainer about the longitudinal axis upon twisting of the swivel head relative to the swivel connector, while allowing the valve retainer to swivel relative to the swivel connector about the first and second transverse axes.

* * * * *